US005923943A

United States Patent [19]

Ahn

[11] Patent Number: 5,923,943

[45] Date of Patent: Jul. 13, 1999

[54] DEVICE AND METHOD FOR REDUCING REVERSE TRANSFER OF ELECTROPHOTOGRAPHIC IMAGE

[75] Inventor: Byung-Sun Ahn, Suwon, Rep. of Korea

[73] Assignee: SamSung Electronics Co., Ltd., Suwon, Rep. of Korea

[21] Appl. No.: 08/922,304

[22] Filed: Sep. 2, 1997

[30] Foreign Application Priority Data

Sep. 2, 1996 [KR] Rep. of Korea ..... 96-37923

[51] Int. Cl.[6] ..... G03G 15/16

[52] U.S. Cl. ..... 399/390; 399/388

[58] Field of Search ..... 399/98, 313, 381, 399/388, 390, 310

[56] References Cited

U.S. PATENT DOCUMENTS 5,036,360 7/1991 Paxon et al. .
5,049,937 9/1991 Takeda .
5,065,233 11/1991 Oka .
5,099,281 3/1992 Bhagat .
5,140,375 8/1992 Shindo et al. .
5,166,734 11/1992 Pinhas et al. .
5,635,323 6/1997 Nakamura et al. ..... 430/120 X
5,740,508 4/1998 Matsuura et al. ..... 399/390 X

FOREIGN PATENT DOCUMENTS 4-216569 8/1992 Japan .
7-160129 6/1995 Japan .
8-123219 5/1996 Japan .

*Primary Examiner*—Arthur T. Grimley
*Assistant Examiner*—Quana Grainger
*Attorney, Agent, or Firm*—Robert E. Bushnell, Esq.

[57] ABSTRACT

A device and a method for reducing contamination of the rear surface of recording papers during formation of a next image, with residual developing material adhered to a photosensitive drum and a transfer roller, by polarizing the recording papers.

16 Claims, 3 Drawing Sheets

DEVICE AND METHOD FOR REDUCING REVERSE TRANSFER OF ELECTROPHOTOGRAPHIC IMAGE

CLAIM OF PRIORITY

This application makes reference to, incorporates the same herein, and claims all benefits accruing under 35 U.S.C. §119 from an application entitled *Device And Method For Reducing Reverse Transfer of Electrophotographic Image* earlier filed in the Korean Industrial Property Office on Sep. 2, 1996, and there duly assigned Serial No. 96-37923 by that Office.

BACKGROUND OF THE INVENTION

1. Field of the Invention

The present invention relates to electrophotography developing systems. More specifically, the present invention relates to image transfer processes and mechanisms in an electrophotography developing system.

2. Description of the Prior Art

Electrophotography developing systems are widely used in copying machines, laser beam printers, LPH (LED(Light Emitting Diode) print head) printers, paper facsimile machines and the like. Conventional electrophotography developing entails repeating a cycle of charging a medium, exposing and developing the medium, then transferring the image to another medium and fixing it thereto. Contact charging systems have been adapted widely to minimize generation of ozone that occurs during the charging operation.

Several types of electrophotography apparatuses are described in the patent literature. U.S. Pat. No. 5,166,734, for an *Imaging System Including Pre-transfer Discharge* to Pinhas et al., employs a photoconductive drum which is charged by a corotron. The image portions are discharged while the background portions remain at full charge. Referring to column 4, lines 39–44, a spray of liquid toner may be directed onto a portion of the roller 38 or onto a portion of photoconductive drum 10. Referring to column 5, lines 63–68, an intermediate transfer member 30 is maintained at a voltage and temperature suitable for electrostatic transfer of the image thereto. Referring to column 7, lines 20–26, the optimum transfer potential of the intermediate transfer member is −400 volts. The image transfer medium does not contain the surface having a positive charge.

U.S. Pat. No. 5,140,375, for an *Image Forming Apparatus* to Shindo et al., includes a brush which induces a bias voltage on a recording sheet. Referring to column 7, lines 59–65, the bias voltage induced on the sheet is controlled between 0.25 to 2.0K Volts and exhibits the same polarity as the toner.

U.S. Pat. No. 5,036,360, for a *Moisture Compensation for Electrostatographic Apparatus* to Paxon et al., induces an electrostatic charge of a predetermined primary voltage $V_o$ to the surface of a photoconductive belt. Referring to column 3, lines 26–30, the belt brings the areas bearing latent charge images into a development station 38. Referring to lines 33–38, charged toner particles on preselected magnetic brushes are attracted to the oppositely-charged latent image patterns on the belt.

I have noticed that the developing material that remains, that is, the non-transfer developing material, adheres to the photosensitive drum due to fatigue phenomenon common to photosensitive drums. This non-transferred developing material contaminates the next image to be transferred to the recording papers. Additionally, some of the non-transferred developing material is transferred to the transfer roll. Some of this residual developing material on the transfer roll subsequently is transferred to the rear surface of subsequent recording papers being developed, introducing unwanted latent images thereon.

I have found that the art represented by these exemplary references demonstrates a need for an electrophotography system which minimizes the contamination of recording papers with latent images due to the unwanted transfer residual developing material.

SUMMARY OF THE INVENTION

The present invention contemplates a device and process for reducing reverse transfer of an image forming apparatus using an electrophotography developing system, wherein a photosensitive drum adhered with developing material contacts a charged front surface of a recording paper, and a transfer roller contacts the rear surface of the recording papers, the rear surface exhibiting a charge having the same polarity as the developing material and the front surface exhibiting a charge having the opposite polarity.

An object of the invention is to provide a device and method for reducing contamination on the front and rear surfaces of recording papers by residual developing material adhered to the photosensitive drum and transfer roller of an electrophotography apparatus.

BRIEF DESCRIPTION OF THE DRAWINGS

The above ands other objects, features and advantages of the present invention will be more clearly understood from the following detailed description taken in conjunction with the accompanying drawings, in which.

DETAILED DESCRIPTION OF THE PREFERRED EMBODIMENT

Figure 1:
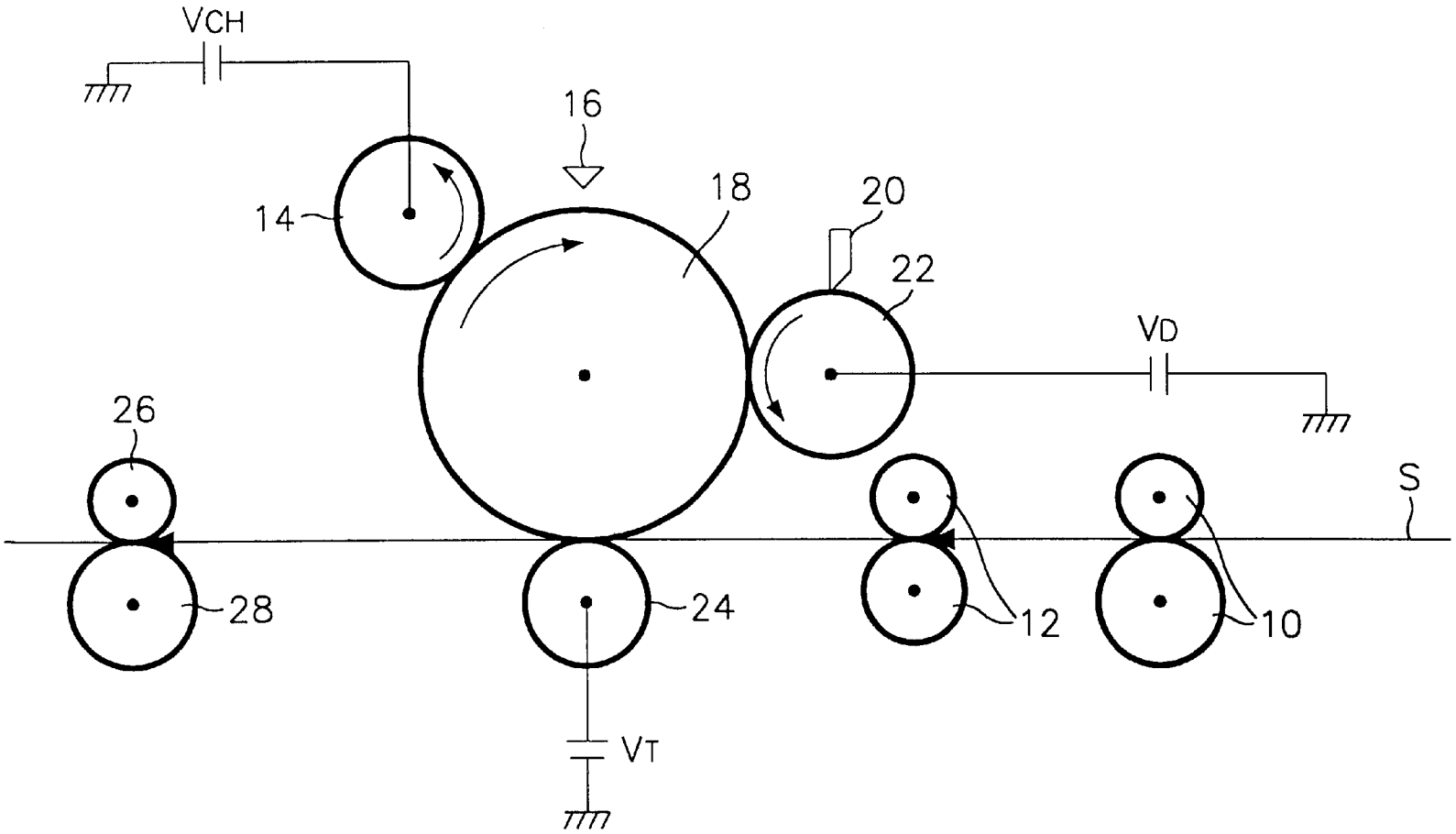
FIG. 1 is a schematic diagram of an electrophotography developing system.

Referring to FIG. 1, a typical contact changing system is depicted schematically. A conductive roller or brush 14 with a uniform negative charge contacts a photosensitive drum 18 creating a potential on the surface of the photosensitive drum 18 in the range of about −500 volts to −600 volts. The reference character S represents the path of recording papers. The photosensitive drum 18 rotates in the direction indicated by the arrow, driven by an engine (not shown).

Simultaneously, a pair of conveyor rollers 10 convey recording papers from a cassette (not shown) to a pair of register rollers 12. The register rollers 12 order the leading edges of the recording papers prior to their introduction into the transfer roller 24.

An exposing device 16 exposes the surface of the photosensitive drum 18 corresponding to an image to be printed, thus creating an electrostatic latent image at the surface of the drum. The surface potential of −500 volts to −600 volts is maintained on the non-exposed portion of the drum while the electrostatic latent image portion has a surface potential of about 0 volts.

The electrostatic latent image at the surface of the photosensitive drum 18, then must be developed and converted into a visible image with developing material. A developing bias voltage $V_D$ of about −450 volts is applied to a developing roller 22, thus the developing material applied thereto by a doctor blade 20 also exhibits a negative charge. The developing material is transferred to the exposed region of the photosensitive drum 18 by the potential difference of the developed region where the developing roller 22 and the photosensitive drum 18 contact each other. The developing material next is transferred from the exposed region of the photosensitive drum 18 to the recording papers. The transfer roller 24 draws the developing material from the surface of the photosensitive drum 18 toward the recording papers with a transfer voltage $V_T$ of about 1.3 to 1.5 kilovolts.

Once the developing material is transferred to the recording papers, it must be fixed at the surface of the recording papers by heat and pressure of a heating roller 28 and a pressure roller 26. Once fixed, the recording papers are ejected to an exterior of the image forming apparatus to copy or print the recording papers.

Some developing material remains adhered to the photosensitive drum 18, hereinafter referred to as non-transfer developing material, due to fatigue phenomenon common to photosensitive drums. This non-transferred developing material contaminates the next image to be transferred to the recording papers. Additionally, some of the non-transferred developing material is transferred to the transfer roll. Some of this residual developing material on the transfer roll subsequently is transferred to the rear surface of subsequent recording papers being developed, introducing unwanted latent images thereon.

Figure 2:
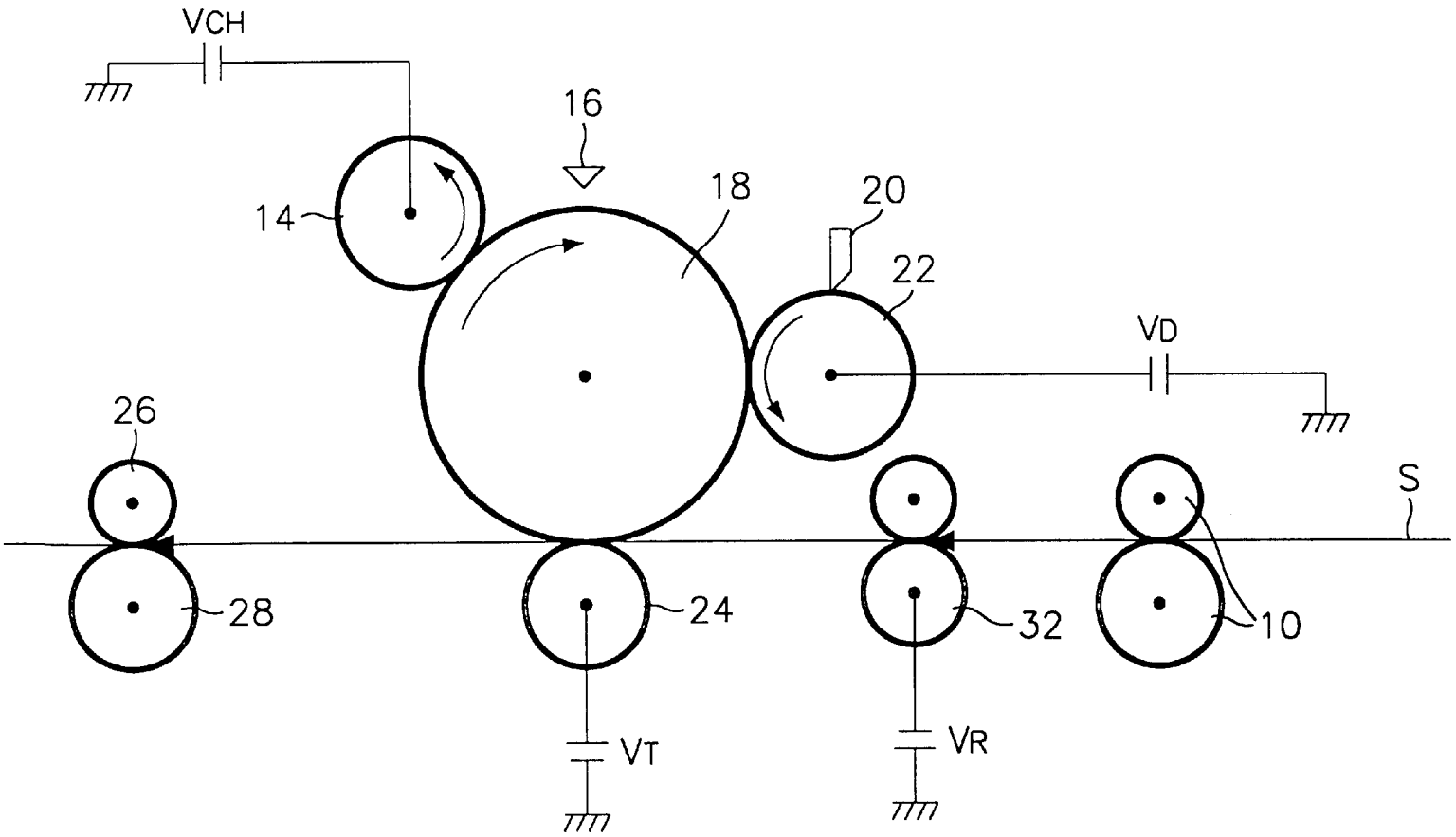
FIG. 2 is a schematic diagram of an electrophotography developing system constructed according to the principles of the present invention.

Referring to FIG. 2, a schematic diagram of the present electrophotography developing system is provided. The device includes a power supply $V_R$ which imparts a bias voltage of −10 to −100 volts on conductive register rollers 32. The register rollers 32 convey and simultaneously apply the voltage potential to the rear surface of the recording papers, thus the front surface is polarized at 10 to 100 volts.

Figure 3:
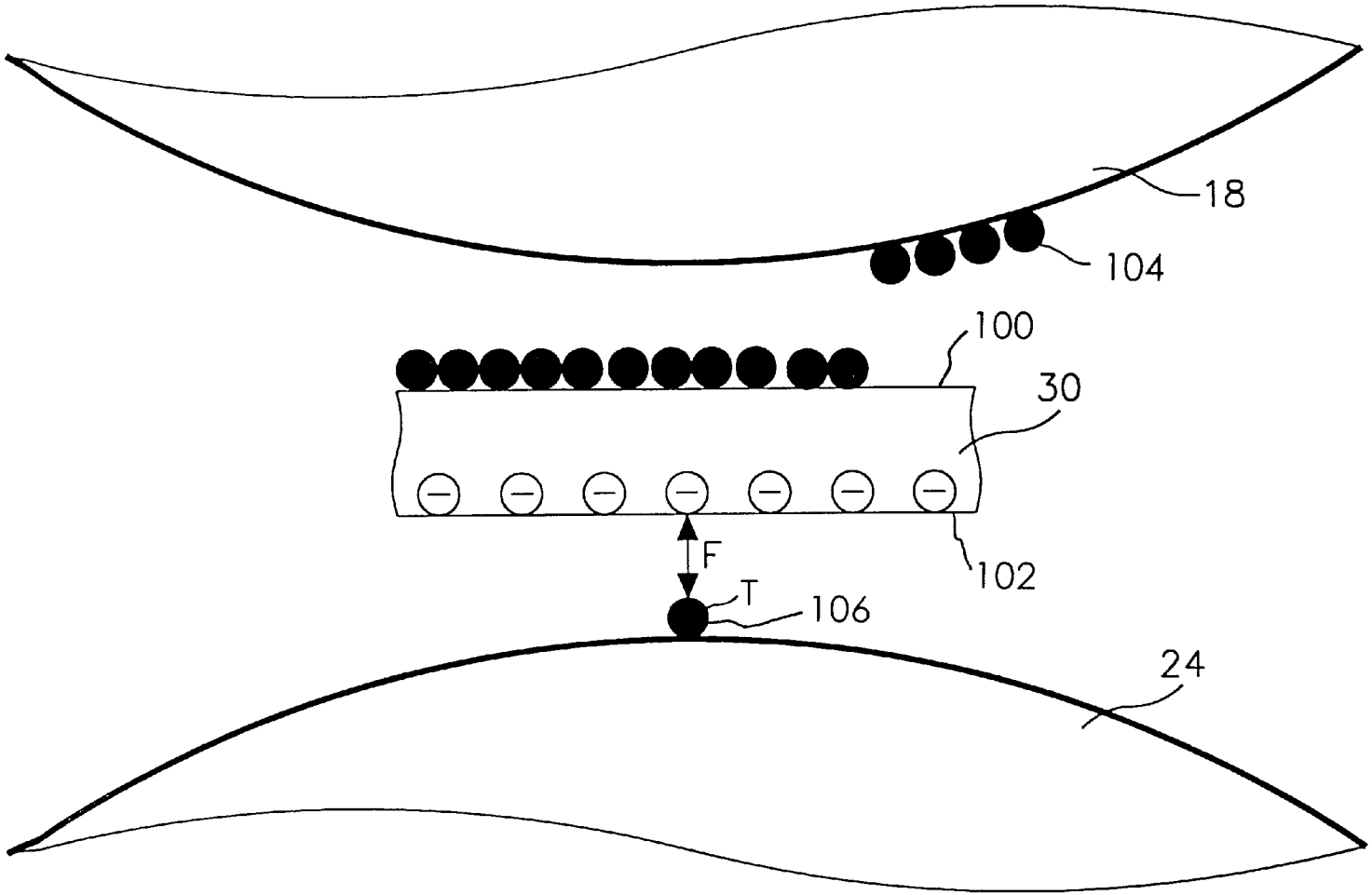
FIG. 3 is a diagram showing the charge dynamics of the photosensitive drum, transfer roller and recording paper during the practice of the present invention.

Referring also to FIG. 3, the charged recording papers are received in a developing area, between the transfer roller 24 and the photosensitive drum 18. The recording papers are charged such that the developing material 104 on the photosensitive drum 18 is conveyed to the front surface 100 of the recording papers only. Any residual reverse-charge developing material (not shown) on the surface of the photosensitive drum 18, having a positive potential, is discouraged from transferring the positively-charged front surface 100 of the recording papers.

The transfer roller 24, having received some residual developing material 106 from the photosensitive drum 18, ordinarily would re-transfer the material 106 to the rear surface 102 of recording papers 30. However, according to the present invention, the rear surfaces 102 of the recording papers are negatively charged, thus repel the retransfer of the residual developing material 106 from the transfer roller 24.

In a preferred embodiment of the present invention, the recording papers conveyed through the register rollers to the transfer roller and the photosensitive drum each have a rear surface that is charged negatively and a front surface that is charged positively. When the rear surface of the recording papers has a negative charge, and the residual developing material adhered to the transfer roller has a negative charge, less residual developing material is transferred to the rear surface of the recording papers. This occurs because like charges repel, thus the negatively charged developing material on the transfer roller repels the negatively charged rear surface of the recording papers.

Also, any reverse charge developing material remaining on the photosensitive drum, exhibiting a positive charge, is discouraged from transferring to the front surface of the recording papers, which is positively charged. This occurs because, although the photosensitive drum repels the reverse charge developing material, the repulsion is significantly less than that exerted by the recording papers.

As apparent from the foregoing, the present invention advantageously reduces the contamination of the rear surface of the recording papers to provide a cleaner image upon successive image transfers.

It should be understood that the present invention is not limited to the particular embodiment disclosed herein, rather to include all embodiments with in the scope of the appended claims.

What is claimed is:

1. An electrophotography developing apparatus, comprising:

a photosensitive drum;

a transfer roller; and means for polarizing opposite surfaces of a recording paper prior to reception of the recording paper between the photosensitive drum and the transfer roller, said means for polarizing having a voltage potential in a range of from −10 to −100 volts to provide a front surface of the recording paper with a positive charge to repel residual developing material from being transferred to the recording paper, the front surface of the recording paper for contacting the photosensitive drum when the recording paper is received between the photosensitive drum and the transfer roller.

2. The electrophotography developing apparatus as recited in claim 1, wherein the front surface of the recording paper exhibits a voltage potential in a range of from 10 to 100 volts.

3. The electrophotography developing apparatus as recited in claim 2, wherein a rear surface of the recording paper exhibits a negative charge.

4. The electrophotography developing apparatus as recited in claim 1, wherein a rear surface of the recording paper exhibits a negative charge.

5. An electrophotography developing apparatus, comprising:

a photosensitive drum exhibiting a negative voltage potential;

a transfer roller exhibiting a positive voltage potential;

an exposing device for imparting an image on said photosensitive drum;

a developing roller, exhibiting a negative voltage potential, for applying negatively-charged developing material on said photosensitive drum; and a pair of rollers for contacting a recording paper and inducing a voltage potential between a front surface and a rear surface of the recording paper, prior to reception of the recording paper between said photosensitive drum and said transfer roller, said pair of rollers having a voltage potential in a range of from −10 to −100 volts to provide the front surface of the recording paper with a positive charge to repel residual developing material from being transferred to the recording paper, the front surface of the recording paper for receiving developing material from said photosensitive drum when the recording paper is received between said photosensitive drum and said transfer roller.

6. The electrophotography developing apparatus as recited in claim 5, wherein the front surface of the recording paper exhibits a voltage potential in a range of from 10 to 100 volts.

7. The electrophotography developing apparatus as recited in claim 6, wherein the rear surface of the recording paper exhibits a negative charge.

8. The electrophotography developing apparatus as recited in claim 5, wherein the rear surface of the recording paper exhibits a negative charge.

9. An electrophotography developing method, comprising the steps of:

inducing a positive charge on a front surface of a recording paper to repel residual developing material from being transferred to the recording paper using a means for polarizing opposite surfaces of the recording paper, the means for polarizing having a voltage potential in a range of from −10 to −100 volts to induce the positive charge on the front surface of the recording paper; and introducing, after inducing the positive charge on the front surface of the recording paper, the recording paper between a photosensitive drum and a transfer roller, the front surface of the recording paper contacting the photosensitive drum.

10. The electrophotography developing method as recited in claim 9, wherein the front surface of the recording paper exhibits a voltage potential in a range of from 10 to 100 volts.

11. The electrophotography developing method as recited in claim 10, wherein a rear surface of the recording paper exhibits a negative charge.

12. The electrophotography developing method as recited in claim 9, wherein said means for polarizing includes a pair of rollers having a voltage potential in a range of from −10 to −100 volts, contacting the recording paper.

13. The electrophotography developing method as recited in claim 12, wherein the front surface of the recording paper exhibits a voltage potential in a range of from 10 to 100 volts.

14. The electrophotography developing method as recited in claim 13, wherein a rear surface of the recording paper exhibits a negative charge.

15. The electrophotography developing method as recited in claim 12, wherein a rear surface of the recording paper exhibits a negative charge.

16. The electrophotography developing method as recited in claim 9, wherein a rear surface of the recording paper exhibits a negative charge.

* * * * *